US007108640B2

(12) United States Patent
Emmert

(10) Patent No.: US 7,108,640 B2
(45) Date of Patent: Sep. 19, 2006

(54) STILT DEVICE WITH IMPROVED LEG ATTACHMENT ASSEMBLY

(75) Inventor: Raymond L. Emmert, Humacao, PR (US)

(73) Assignee: Emmert Second Limited Partnership, Humacao, PR (US)

( * ) Notice: Subject to any disclaimer, the term of this patent is extended or adjusted under 35 U.S.C. 154(b) by 457 days.

(21) Appl. No.: 10/388,572

(22) Filed: Mar. 14, 2003

(65) Prior Publication Data

US 2003/0203793 A1 Oct. 30, 2003

Related U.S. Application Data

(60) Provisional application No. 60/375,474, filed on Apr. 25, 2002.

(51) Int. Cl.
*A63B 25/00* (2006.01)
*A61F 2/60* (2006.01)

(52) U.S. Cl. ..... 482/75; 623/28

(58) Field of Classification Search ..... 482/75–77, 482/79, 80, 146–147; 623/28; 36/34 R, 36/40–42

See application file for complete search history.

(56) References Cited

U.S. PATENT DOCUMENTS 2,736,902 A * 3/1956 Bass ..... 623/28
2,747,300 A * 5/1956 Field ..... 36/7.5
2,802,217 A 8/1957 Wihoyte
2,837,335 A 6/1958 Koenig
3,058,120 A * 10/1962 Smith et al. ..... 623/28
3,102,272 A * 9/1963 Emmert ..... 623/28
3,346,882 A * 10/1967 Wilhoyte ..... 623/28
3,902,199 A * 9/1975 Emmert ..... 623/28
4,415,063 A 11/1983 Hutchison
5,645,515 A * 7/1997 Armstrong et al. ..... 482/75
6,517,586 B1 2/2003 Lin
6,840,893 B1 * 1/2005 Yoon ..... 482/77

* cited by examiner

*Primary Examiner*—Gregory L. Huson
*Assistant Examiner*—Fenn C. Mathew
(74) *Attorney, Agent, or Firm*—Fellers, Snider, et al.

(57) ABSTRACT

A stilt device for supporting a user above a base support surface. The stilt device includes a shoe plate, a base member and at least one intermediary strut. A leg attachment assembly comprises an elongated support pole which extends upwardly from the strut. In some embodiments, a clam-shell assembly is attached to a distal end of the support pole and comprises opposing, curved inner and outer plates configured to surround and support the user's leg. A hinge assembly facilitates rotation of the inner plate with respect to the outer plate between open and closed positions. In other embodiments, a support attachment assembly utilizes a u-shaped bracket and a nested, h-shaped clamp to attach the medial portion of the support pole to the shoe plate. The support attachment assembly establishes and secures both the angular extent and length of the support pole.

32 Claims, 10 Drawing Sheets

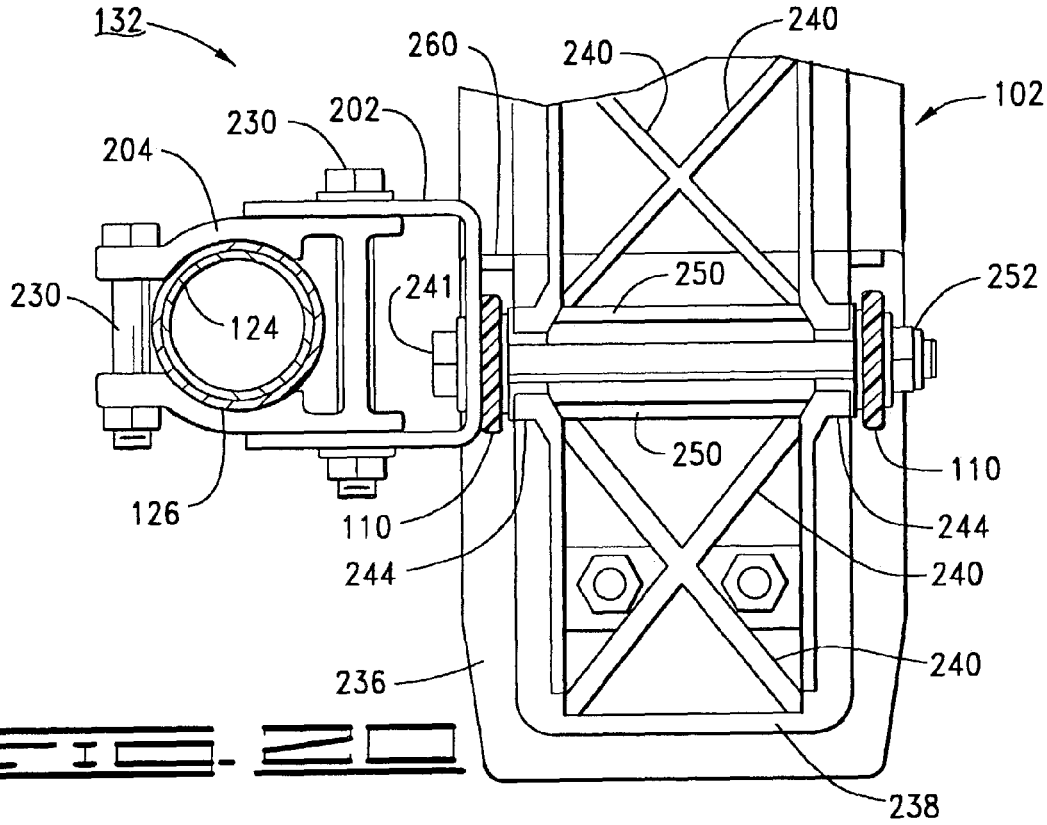
FIG. 20
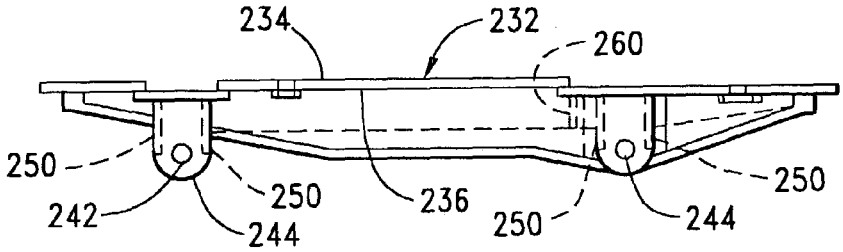
FIG. 21
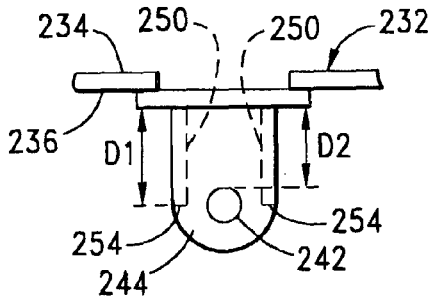
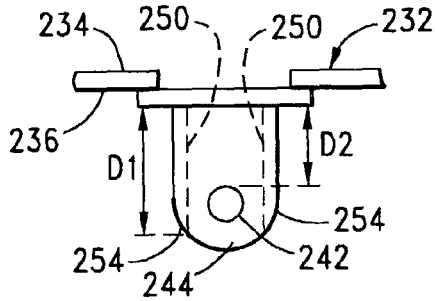
FIG. 22 FIG. 23

STILT DEVICE WITH IMPROVED LEG ATTACHMENT ASSEMBLY

RELATED APPLICATIONS

This application makes a claim of domestic priority under 35 U.S.C. § 119(e) to U.S. Provisional Patent Application No. 60/375,474 filed Apr. 25, 2002.

FIELD OF THE INVENTION

This invention relates generally to leg extension mechanisms (stilt devices) used to allow a user to maneuver at an increased height.

BACKGROUND

Leg extension mechanisms (stilt devices) advantageously allow a user to maneuver at an increased height above a base surface. Stilt devices are often used in the construction industry to allow users to perform building or repair operations several feet above the ground and which could not otherwise be reachable without use of a scaffold or support structure.

A particularly useful stilt device is disclosed in U.S. Pat. No. 3,902,199 issued to Emmert. While operable, there remains a continual need for advancements in the art to improve flexibility, adjustability, user comfort and to reduce weight in such stilt devices, and it is to these and other improvements that the present invention is generally directed.

SUMMARY OF THE INVENTION

In accordance with preferred embodiments, a stilt device is disclosed for supporting a user above a base support surface. The stilt device comprises a shoe plate adapted to support a shoe of the user, a base member adapted for supporting contact upon the base support surface, and at least one intermediary support strut disposed therebetween.

A leg attachment assembly is configured to support the leg of the user and preferably comprises an elongated support pole having a proximal end, a distal end and a medial portion, the proximal end affixed to the at least one support strut and the medial portion extending adjacent the shoe plate.

In some preferred embodiments, the leg attachment assembly further comprises a clam-shell assembly hingedly supported by the distal end of the support pole. The clam-shell assembly is preferably configured to support the leg of the user just below the user's knee.

The clam-shell assembly preferably comprises a curved outer plate having a convex outer surface, a concave inner surface, and opposing first and second edge surfaces. A curved inner plate is placed in facing relation to the outer plate and includes a convex outer surface, a concave inner surface and first and second edge surfaces.

A hinge assembly is connected between the respective first ends of the inner and outer plates to facilitate rotation of the inner plate with respect to the outer plate between an open position and a closed position. The open position accommodates insertion and removal of the leg of the user. The respective second edge surfaces of the inner and outer plates are brought into alignment in the closed position.

In further preferred embodiments, the leg attachment assembly further comprises a support attachment assembly configured to adjustably connect the support pole relative to the shoe plate. The support attachment assembly preferably comprises a substantially u-shaped bracket having a medial portion between a pair of opposing support arms, with the medial portion connected to the shoe plate.

A substantially h-shaped clamp is nested within the u-shaped bracket and includes a central web which supports a pair of opposing clamping arms, the pair of opposing clamping arms each comprising an inner arcuate clamping surface configured to abut the support pole.

A first fastener preferably extends through the respective support arms and through the central web of the h-shaped clamp to establish a desired angular extent of the support pole with respect to the shoe plate, with the first fastener disposed on a first side of the support pole. A second fastener preferably extends through the pair of opposing clamping arms on a second side of the support pole opposite the first side to cause the respective clamping surfaces to exert a clamping force upon the support pole. In this way, the first and second fasteners operate independently to set the angular extent and length of the support pole.

In yet further embodiments, the shoe plate is provided with opposing upper and lower surfaces, the upper surface configured to support the foot of the user. A pair of opposing brackets extend downwardly from the lower surface. Each bracket includes an aperture a first selected distance from the bottom surface to accommodate a fastener used to affix the shoe plate to the intermediary support strut between the shoe plate and the base member.

The shoe plate further includes at least one strengthening rib between the pair of opposing brackets. The strengthening rib extends downwardly from the lower surface and contactingly abuts each of the brackets so as to run substantially along the length of the fastener. The strengthening rib is provided with a distal edge which extends from the bottom surface a second distance greater than the first distance, to thereby resist compression of the pair of opposing brackets when the fastener is installed.

These and various other features and advantages which characterize the claimed invention will be apparent from a reading of the following detailed description and a review of the associated drawings.

BRIEF DESCRIPTION OF THE DRAWINGS

FIGS. 20 and 21 show a shoe plate of the stilt device in greater detail.

FIG. 22 shows a strengthening rib of the shoe plate in greater detail.

FIG. 23 provides an alternative preferred embodiment of the strengthening rib of FIG. 22.

DETAILED DESCRIPTION

Numerous possible variations and modifications will readily occur to the skilled artisan upon a review of the following discussion. Thus, it will be understood that the various exemplary embodiments disclosed herein are illustrative of, and are not limiting to, the scope of the claimed invention.

Figure 1:
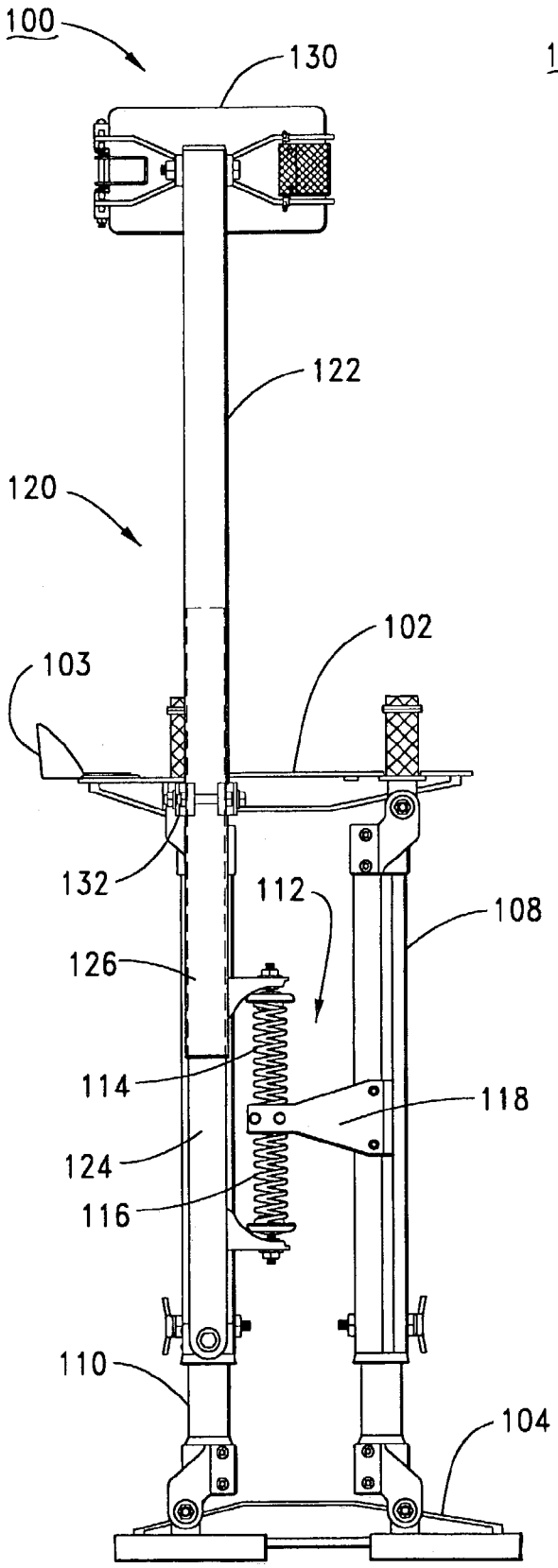
FIG. 1 provides an elevational side view representation of a stilt device constructed in accordance with preferred embodiments of the present invention.
Figure 2:
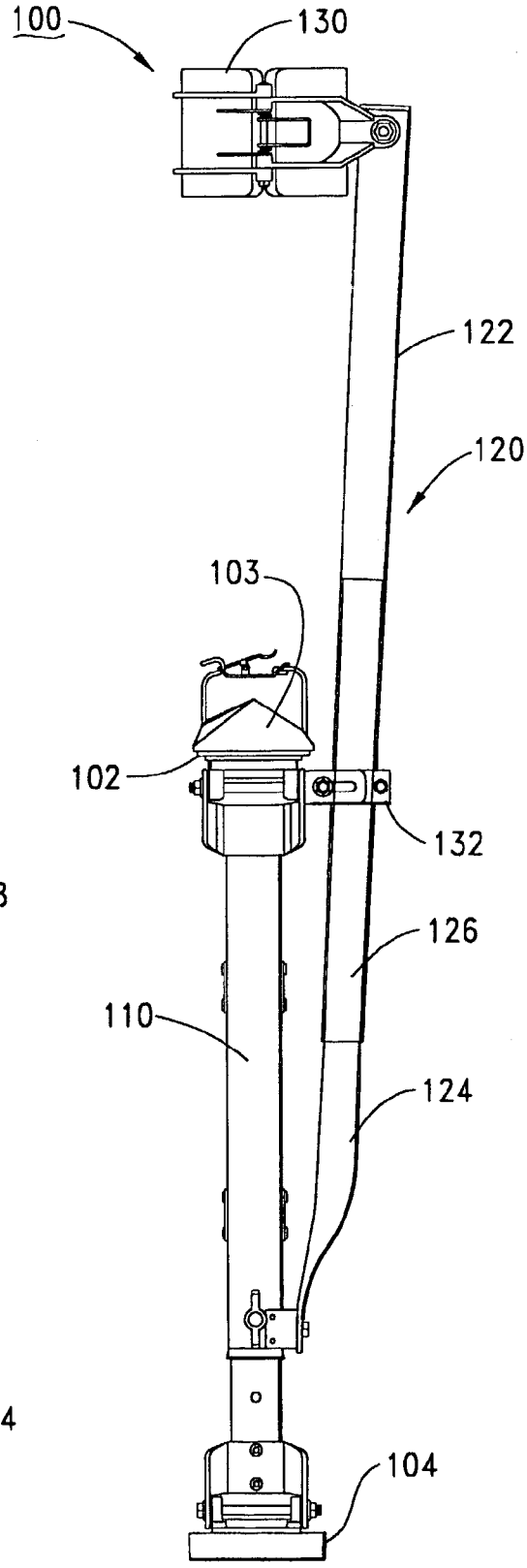
FIG. 2 provides an elevational rear view representation of the stilt device.

FIGS. 1 and 2 show side and rear elevational views, respectively, of a stilt device 100 configured to support a user above a base support (floor) surface (denoted at 101).

A normally horizontal top member, or shoe plate 102 is configured to abuttingly support a shoe or boot worn by a user (not shown). An arcuate heel plate 103 extends upwardly at the rear of the shoe plate 102 to abuttingly support the heel of the user's shoe or boot.

The shoe plate 102 is supported above base support member, or base member 104 by front and rear struts 108, 110. The struts 108, 110 are preferably telescopic in nature to allow the user to selectively adjust via fasteners 111 the relative height of the shoe plate 102 above the base support surface 101.

A damping assembly 112 comprises upper and lower damping springs 114, 116 affixed to the rear strut 110 and a rigid actuator arm 118 which extends from the front strut 108 to a medial position between the springs 114, 116. The damping assembly 112 nominally biases the stilt device 100 to the parallelogram shape shown in FIG. 1. The damping assembly 112 further provides flexibility to the user by permitting limited forward and rearward pivoting of the struts 108, 110 with respect to the shoe plate 102 during maneuvering by the user.

A leg attachment assembly 120 comprises a telescopic support pole 122 (support) which can be adjusted as desired to fit the leg of the user. The support 122 includes inner and outer sleeves 124, 126. A proximal end of the inner sleeve 124 is affixed to the rear strut 110 and a distal end of the inner sleeve 124 is inserted up into the outer sleeve 126.

The leg attachment assembly 120 further preferably comprises a clam-shell assembly 130 and a support attachment assembly 132. A distal end of the outer sleeve 126 supports the clam-shell assembly 130 as discussed below to support the user's leg at a position just below the user's knee. The lateral extent and relative angle of the support 122 with respect to the shoe plate 102 are adjustable using the support attachment assembly 132, also discussed in greater detail below.

It is envisioned that during normal usage a user will typically wear two such stilt devices 100, with one being attached to each leg. The two stilt devices 100 will generally be configured in a mirrored fashion so that the support 122 extends along the outside of each leg. Thus, it will be understood that the stilt device 100 shown in the drawings is a "right-footed" version, and the corresponding "left-footed" version has been omitted for simplicity of discussion.

Figure 3:
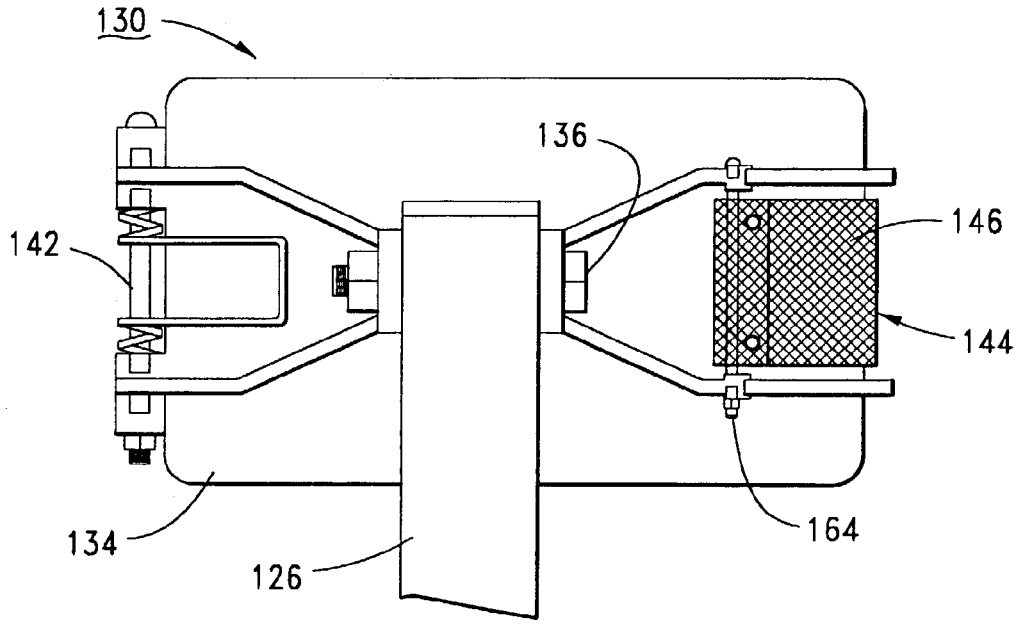
FIG. 3 provides a side view of a clam-shell assembly.
Figure 4:
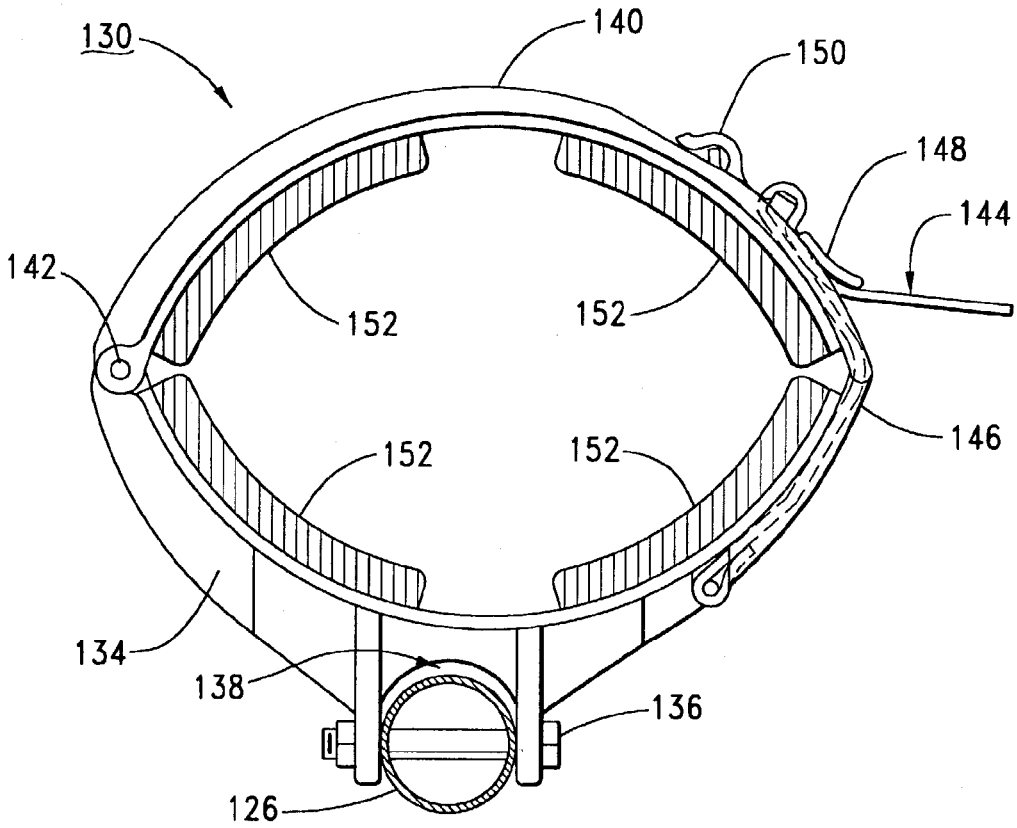
FIG. 4 provides a top plan view of the clam-shell assembly.

FIGS. 3 and 4 provide side and top plan views, respectively, of the clam-shell assembly 130. The assembly 130 includes a curved outer plate 134, which is affixed to the outer sleeve 126 of the support 122 via fastener 136. A gap shown at 138 in FIG. 4 permits pivotal movement of the outer plate 134 with respect to the sleeve 126 to improve comfort and flexibility for the user.

A curved inner plate 140 is disposed in facing relation to the outer plate 134. The inner plate 140 is pivotally affixed to the outer plate 134 via hinge pin 142. A biasing spring 143 preferably biases the inner and outer plates to the closed position as shown in FIG. 4.

A strap assembly 144 secures the inner and outer plates 134, 140 in the closed position around the user's leg during use. The strap assembly 144 includes a flexible nylon or similar strap 146 and a threaded buckle 148. A proximal end of the strap 146 is affixed to the outer plate 134, and the buckle 148 engages a tab 150 on the inner plate 140. In a preferred embodiment, foam blocks 152 are affixed along the interior surfaces of the inner and outer plates 134, 140 to provide further cushioning for the user.

The inner and outer plates 134, 140 are preferably formed from injection molded plastic, nylon, or other suitable material. Various additional views of the outer plate 134 are shown in FIGS. 5–8, and additional views of the inner plate 140 are provided in FIGS. 9–12.

Figure 5:
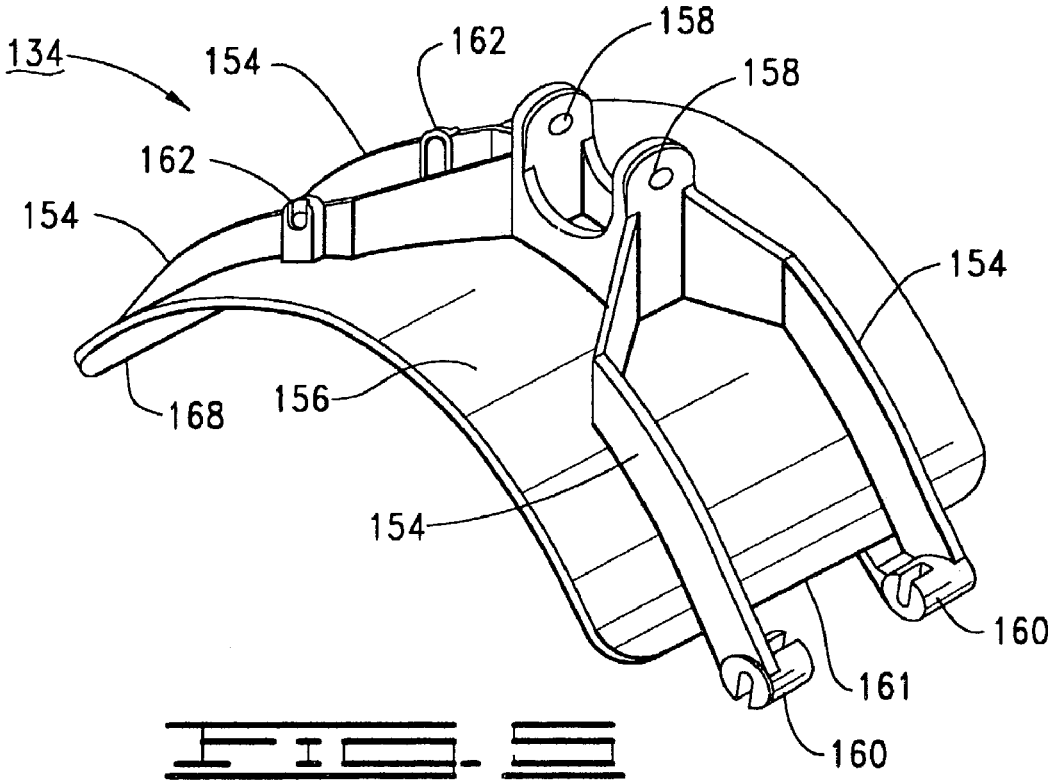
FIGS. 5–8 provide various respective views of an outer plate of the clam-shell assembly.
Figure 6:
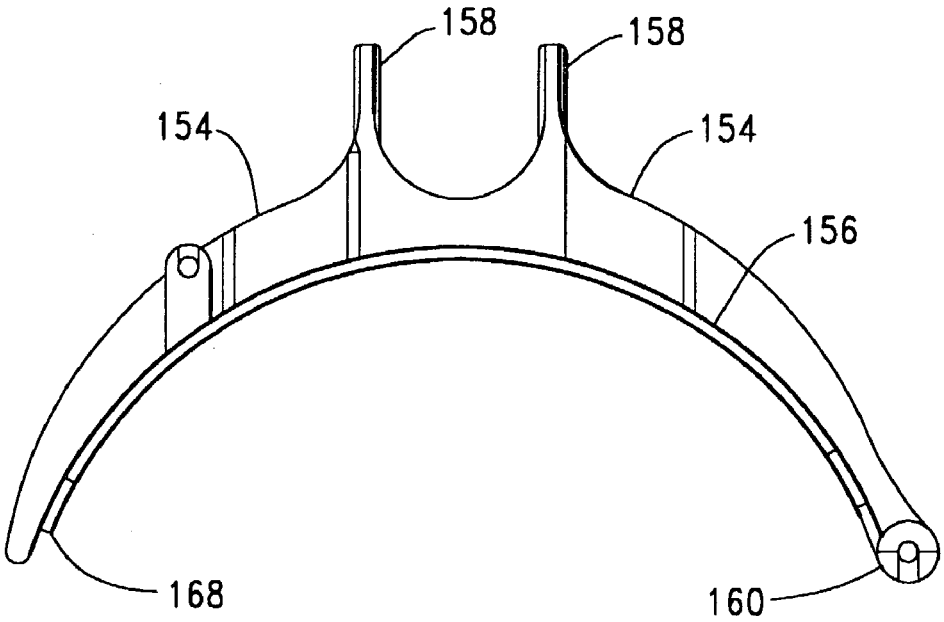
Figure 7:
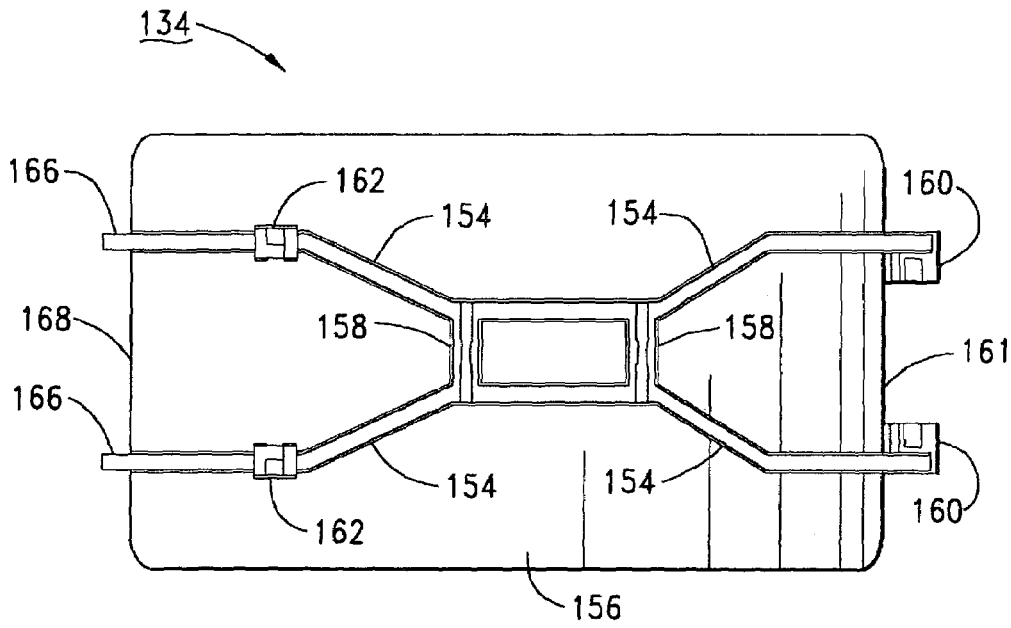
Figure 8:
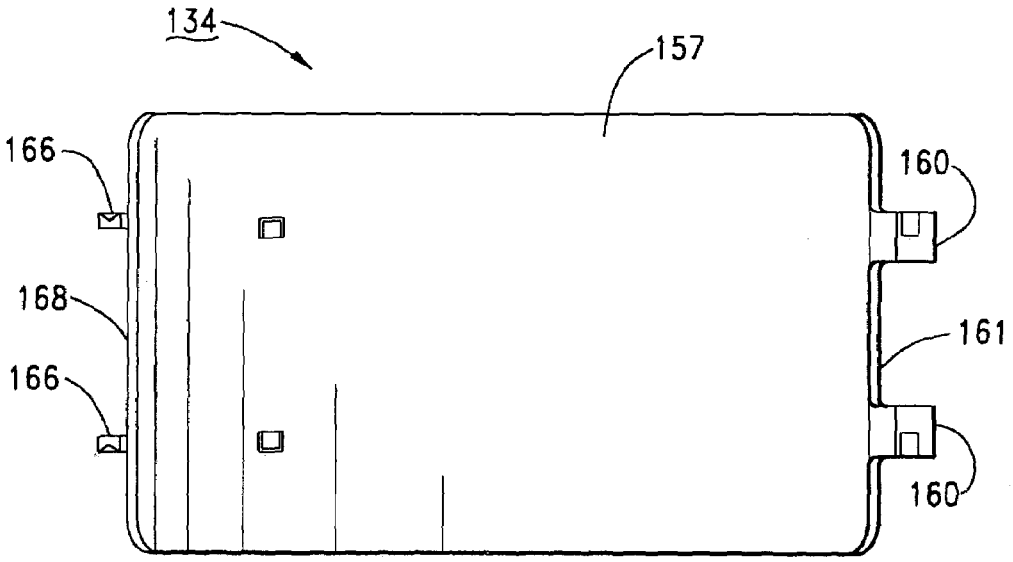

As shown in FIG. 5, the outer plate 134 includes strengthening ribs 154 which extend along a convex outer surface 156 of the plate to provide rigidity and to reduce weight of the overall assembly. A concave inner surface 157 runs adjacent the outer surface 156 along the interior of the plate 134 and preferably supports the foam blocks 152 shown in FIG. 4.

The ribs 154 converge to a pair of opposing, centrally disposed brackets 158 configured to accommodate the fastener 136 (FIG. 4). Hinge pin collars 160 (best viewed in FIGS. 5 and 7) project from a first edge surface 161 of the plate 134 and support the hinge pin 142. Strap collars 162 project adjacent the ribs 154 and support a strap pin 164 used to support a loop of the strap 146 (FIG. 4).

Alignment tabs 166, or ears, extend from the ribs 154 beyond a second edge surface 168 of the outer plate 134. The alignment tabs 166 align with corresponding tabs 170 on the inner plate 140 to ensure desired alignment of the respective plates 134, 140 when the assembly 130 is in the closed position.

Figure 9:
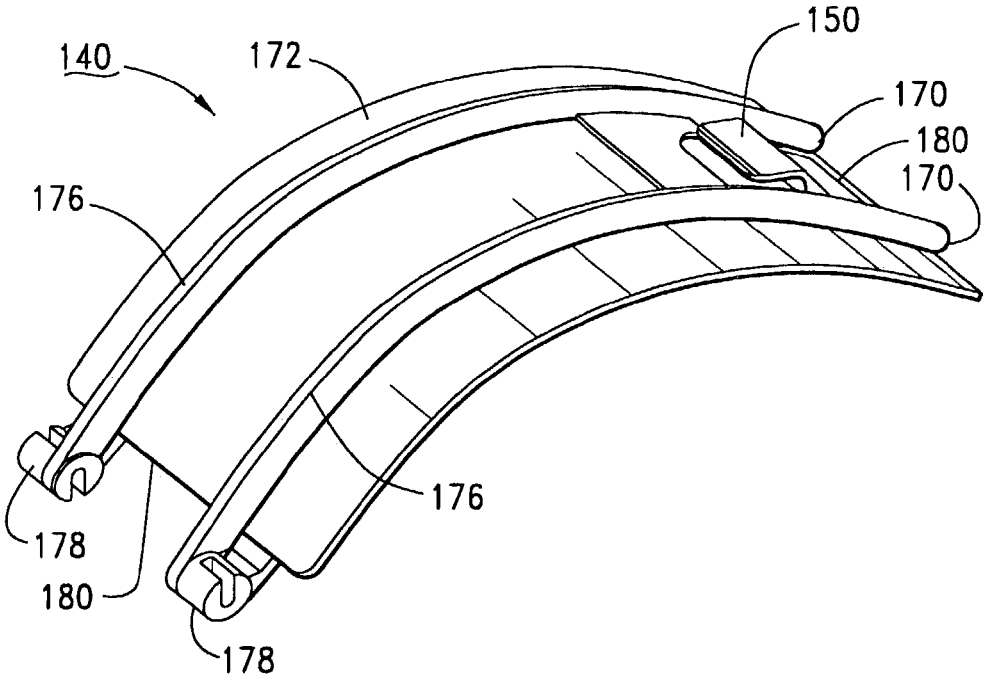
FIGS. 9–12 provide various respective views of an inner plate of the clam-shell assembly.
Figure 10:
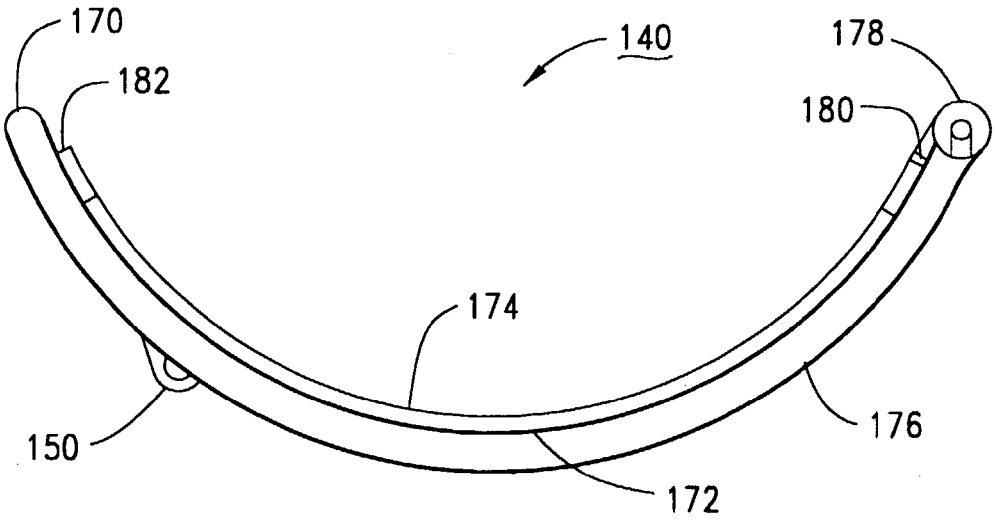
Figure 11:
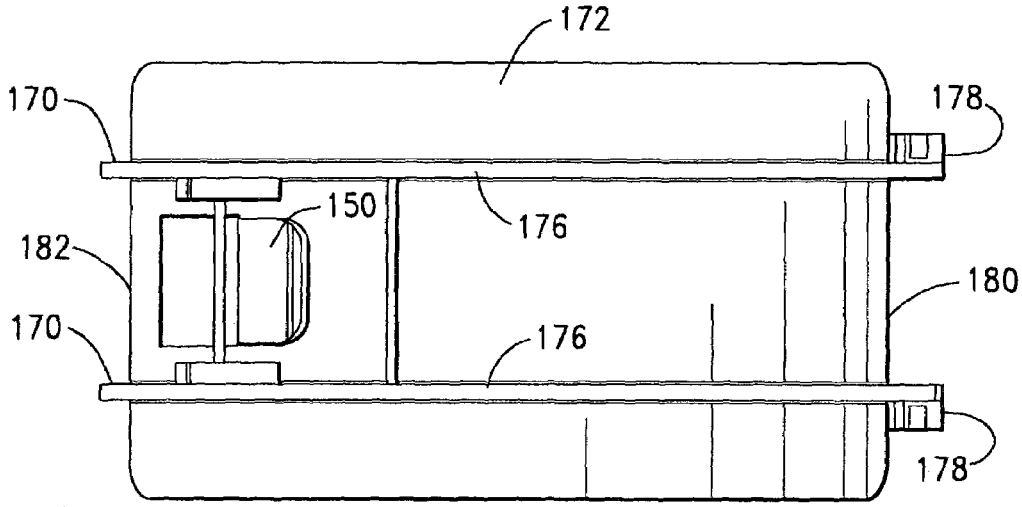
Figure 12:
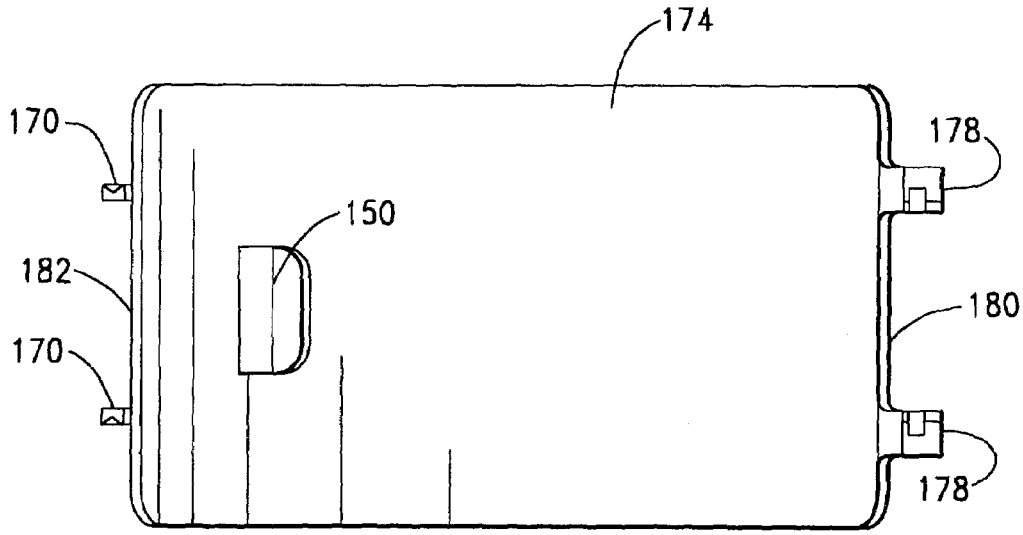

As shown in FIG. 9, the inner plate 140 includes opposing convex and concave outer and inner surfaces 172, 174. Strengthening ribs 176 extend from the outer surface 172 to provide rigidity and reduce weight.

Hinge pin collars 178 project from a first edge surface 180 of the inner plate 140. The collars 178 are preferably configured to rotate about the hinge pin 142, facilitating rotation of the inner plate 140 with respect to the outer plate 134 between open and closed positions.

For reference, at least the pin collars 161, pin collars 178 and the hinge pin 142 are collectively referred to herein as a hinge assembly. The alignment tabs 170 project from a second edge surface 182 of the inner plate 140 opposite the pin collars 178, the second edge surface 182 coming into adjacent alignment with the second edge surface 168 of the outer plate 134 when the attachment assembly 130 is in the closed position.

Figure 13:
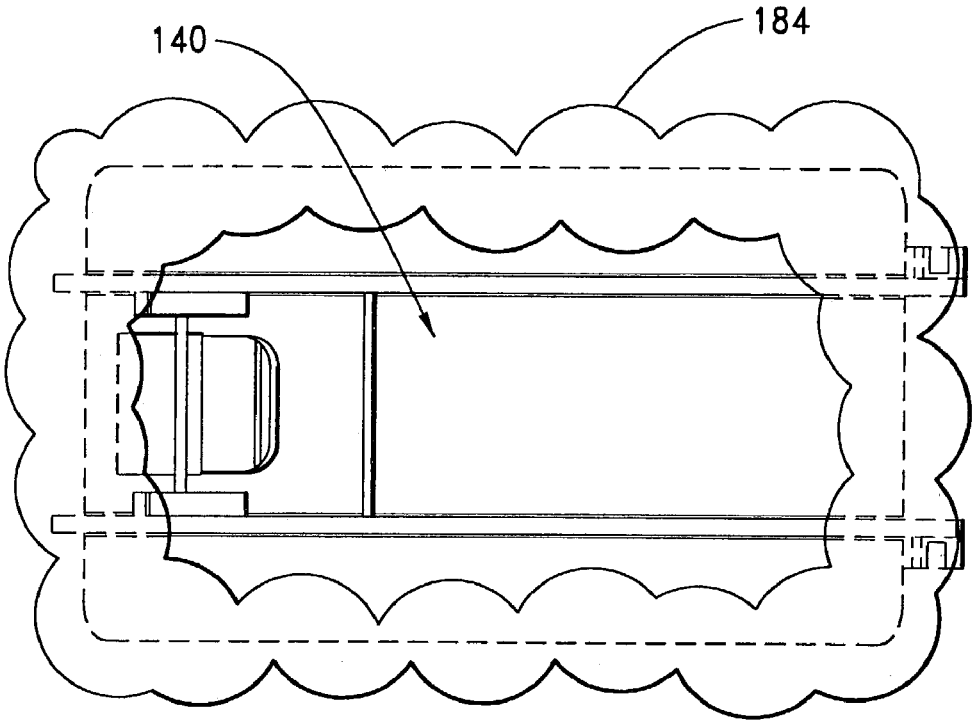
FIGS. 13 and 14 illustrate a removable slipcover.

FIG. 13 shows the inner plate 140 in accordance with an alternative preferred embodiment. In lieu of, or in addition to, the foam blocks 152 shown in FIG. 4, the embodiment of FIG. 13 shows the addition of a padded slipcover 184.

Figure 14:
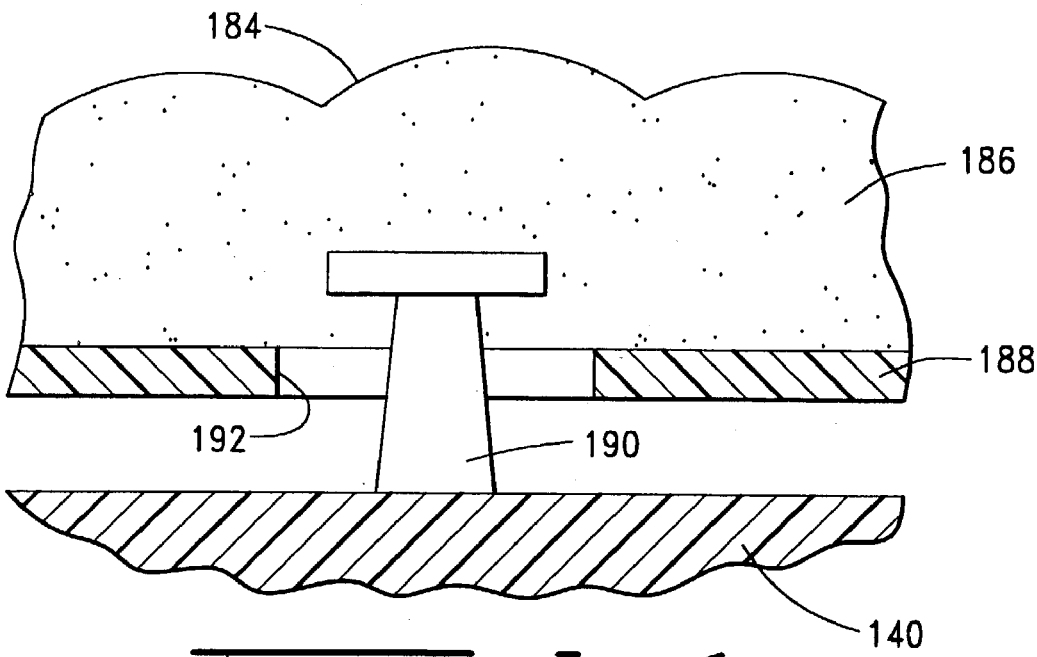

As shown in FIG. 14, the slipcover 184 preferably comprises a soft layer 186 of synthetic or natural material, such as wool. The soft layer 186 is affixed to a durable backing layer 188. The slipcover 184 preferably covers the entire inner surface 174 of the plate 140 and is preferably secured to the plate 140 via a number of fastening posts 190 which extend through corresponding apertures 192 in the backing layer 188.

The slipcover 184 provides additional support, comfort and insulation for the user and is preferably configured to not interfere with the normal opening, closing and adjusting of the support assembly 130. As desired, the fastening posts can alternatively or additionally be supplied to the outer plate 134 so that a second slipcover similar to the slipcover 184 can be applied to the outer plate 134 as well, and secured thereto in similar fashion.

Figure 15:
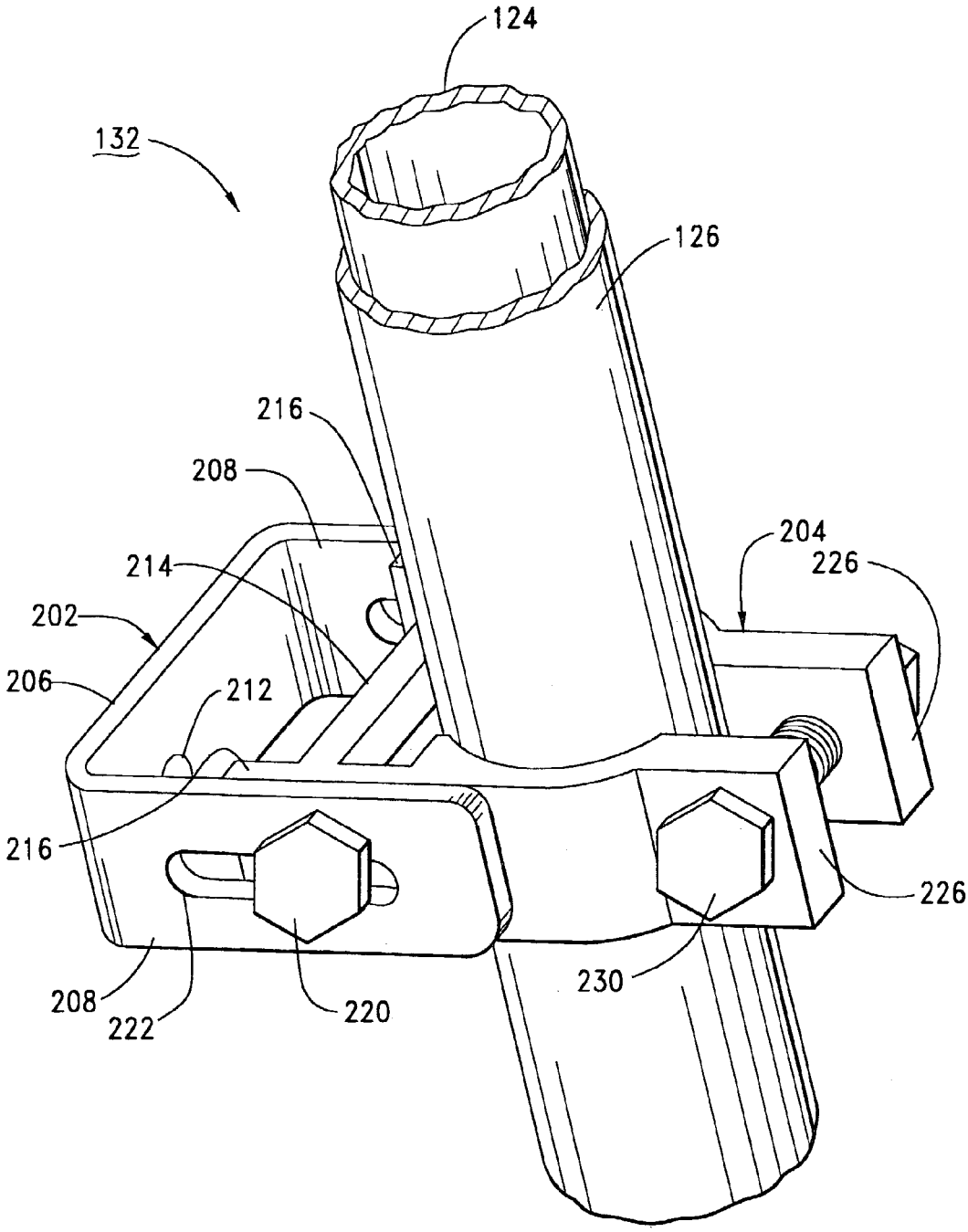
FIG. 15 provides an isometric view of a support attachment assembly.
Figure 16:
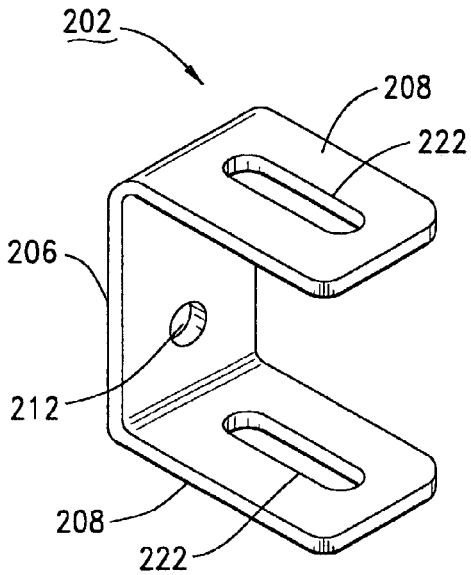
FIGS. 16 and 17 illustrate a unshaped bracket of the support attachment assembly.
Figure 17:
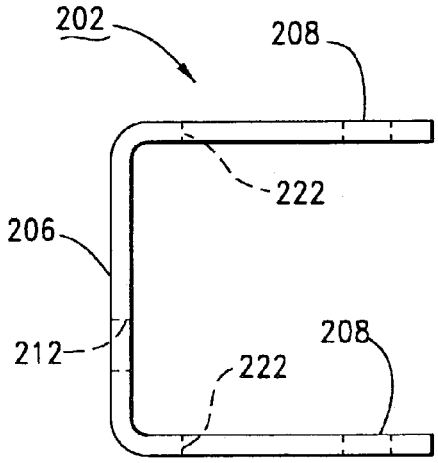
Figure 18:
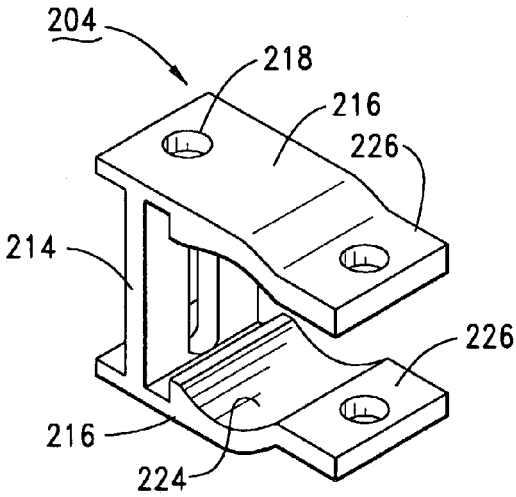
FIGS. 18 and 19 illustrate an h-shaped clamp of the support attachment assembly.
Figure 19:
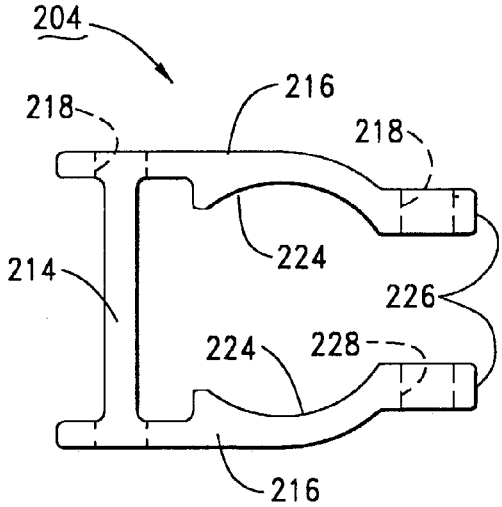

Having concluded a review of the clamshell leg attachment assembly 130, the present discussion will now turn to the support attachment assembly 132. As shown in FIG. 15, the assembly 132 includes a substantially u-shaped bracket 202 and a substantially h-shaped support clamp 204. Additional views of the bracket 202 are provided in FIGS. 16 and 17, and additional views of the clamp 204 are provided in FIGS. 18 and 19.

The bracket 202 includes a medial portion 206 and opposing, symmetric arms 208. The bracket 202 preferably mounts to the shoe plate 102 via fastener 241 (FIG. 1) which extends through aperture 212 in the medial portion.

The clamp 204 includes a central web 214 which supports a pair of opposing, symmetric clamping arms 216. A central aperture 218 extends through a medial portion of the web 214 and the arms 216. The aperture 218 accommodates a first fastener (bolt) 220 used to secure the clamp 204 to the bracket 202.

Elongated slots 222 in the arms 208 allow the clamp 204 to be advanced or retracted within the u-shaped bracket 202 as desired to set the angular position of the support 122. Once adjusted, the fastener 220 is tightened to maintain the desired position.

The clamping arms 216 include cylindrical inner clamping surfaces 224 configured to match the outer surface of the outer sleeve 126. Fastener tabs 226 at the distal ends of the arms 216 include apertures 228 to accommodate a second fastener (bolt) 230. Once the desired elevation of the leg support assembly 130 has been selected by slidingly advancing the outer sleeve 126 over the inner sleeve 124 (FIG. 1), the fastener 230 is tightened, thereby inducing a clamping force (via clamping surfaces 224) upon the support to maintain this desired elevation.

It will be noted that the first fastener 220 remains aligned with the web 214 irrespective of the position of the clamp 204 relative to the bracket 202. This results in the clamping force exerted by the first fastener 220 being centered upon, and opposed by, the compressive strength of the I-beam formed by the web 214 and arms 216. In this way, a selected one of the first and second fasteners 220, 230 can be loosened, adjusted and tightened again independently without affecting the set point established by the remaining one of the fasteners 220, 230.

FIG. 20 provides a bottom plan view of the attachment assembly 132 in conjunction with a portion of the shoe plate 102. The shoe plate is preferably formed from a contiguous piece of injection molded plastic or other suitable material. As further shown in FIG. 21, the shoe plate 102 includes a support portion 232 with opposing top and bottom surfaces 234, 236. The shoe or boot of the user rests upon and is preferably strapped to the top surface 234 using straps or similar attachment devices (not shown in FIG. 20).

A substantially rectangular strengthening flange 238 depends downwardly adjacent the perimeter of the bottom surface 236. Interior, crisscrossing ribs 240 extend as shown within the rectangular extent of the flange 238. The flange and ribs 238, 240 serve to strengthen the shoe plate 102.

A third fastener 241 is used to secure the support attachment assembly 132 to the shoe plate 102, as well as attach the shoe plate 102 to the rear strut 110 (FIG. 1). The fastener 241 extends through apertures 242 (FIG. 21) in opposing brackets 244 provided for that purpose. For reference, a fourth fastener (not shown) is similarly used to attach the shoe plate 102 to the front strut 108 (also shown in FIG. 1) using a second set of the brackets 244.

Strengthening ribs 250 extend from the bottom surface 236 of the shoe plate 102 and extend along the length of the fastener 241 between the opposing brackets 244. The ribs 250 serve to resist compression (bowing) of the shoe plate 102 along an axis parallel to the fastener 241 in response to installation of a locking nut 252 (FIG. 20) onto the fastener.

As shown in greater detail in FIG. 22, a distal edge 254 of each rib 250 extends a distance D1 from the bottom surface 236 of the shoe plate 102. This distance D1 is selected to be greater than a distance D2 between the bottom surface 236 of the shoe plate 102 so that the ribs 250 extend along opposing sides of the fastener 241 when the fastener is installed. Preferably, the brackets extend to or beyond a center of the apertures 242, as exemplified by an alternative embodiment shown in FIG. 23 wherein the ribs substantially extend to a distal edge of the brackets 244.

Returning to FIG. 20, a bracket support rib 260 preferably extends along a direction substantially parallel to the ribs 250. The support rib 260 is configured to abuttingly contact and support the u-shaped bracket 202. This further resists compression of the shoe plate 102. Also, since the aperture 212 in the u-shaped bracket 202 (FIG. 15) through which the fastener 241 extends is preferably offset along the medial portion 206 as shown, the support rib 260 helps to reduce rotational movement of the support attachment assembly 132 with respect to the shoe plate 102 during use.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed.

What is claimed is:

1. In a stilt device for supporting a user above a base support surface to extend the user's effective leg length, the stilt device of the type comprising a laterally extending shoe plate adapted to abuttingly support a foot of the user, a laterally extending base member adapted for abutting contact with the base support surface, and at least one support strut extending between the shoe plate and the base member which establishes a relative elevational spacing therebetween, the improvement comprising a leg attachment assembly configured to support the leg of the user, comprising:

an elongated support pole having a proximal end, a distal end and a medial portion, the proximal end affixed to the at least one support strut and the medial portion extending adjacent the shoe plate; and a clam-shell assembly supported by the distal end of the support pole configured to support a leg of the user, comprising:

a curved outer plate having a convex outer surface, a concave inner surface, and opposing first and second edge surfaces;

a curved inner plate in facing relation to the outer plate and having a convex outer surface, a concave inner surface and first and second edge surfaces; and a hinge assembly connected between the respective first ends of the inner and outer plates facilitating rotation of the inner plate with respect to the outer plate between an open position and a closed position, the open position accommodating insertion of the leg of the user, the closed position aligning the respective second edge surfaces of the inner and cuter plates.

2. The improved stilt device of claim 1, wherein the curved outer plate further comprises a support pole attachment bracket which extends from the outer surface of the curved outer plate to accommodate attachment of the clam-shell assembly to the support pole, the support pole attachment bracket facilitating rotation of the clam-shell assembly with respect to the support pole.

3. The improved stilt device of claim 1, wherein the hinge assembly further comprises a biasing spring which normally biases the clam-shell assembly to the closed position.

4. The improved stilt device of claim 1, wherein the outer plate further comprises at least one outer plate alignment tab which depends from second edge surface of the outer plate, wherein the inner plate further comprises at least one inner plate alignment tab which depends from the second edge surface of the inner plate, and wherein the inner plate alignment tab is brought into abutting alignment with the outer plate alignment tab when the clam-shell assembly is in the closed position.

5. The improved stilt device of claim 1, wherein the outer plate further comprises at least one strengthening rib which depends from and extends along the outer surface of the outer plate to resist deformation of the outer plate.

6. The improved stilt device of claim 1, wherein the inner plate further comprises at least one strengthening rib which depends from and extends along the outer surface of the inner plate to resist deformation of the inner plate.

7. The improved stilt device of claim 1, further comprising means for securing the inner plate to the outer plate when the clam-shell assembly is in the closed position.

8. The improved stilt device of claim 1, further comprising at least one compressible foam block affixed to at least a selected one of the inner surface of the outer plate and the inner surface of the inner plate to contact the leg of the user.

9. The improved stilt device of claim 1, further comprising a removeable slip cover comprising a layer of compressive material configured to extend along a selected one of the inner surface of the outer plate and the inner surface of the inner plate to contact the leg of the user.

10. The improved stilt device of claim 9, further comprising a support post which extends from a selected one of the outer surface of the outer plate and the outer surface of the inner plate to secure the removeable slip cover.

11. The improved stilt device of claim 1, wherein the outer and inner plates are formed using an injection molded process.

12. The improved stilt device of claim 1, wherein the hinge assembly comprises an elongated hinge pin, a first pin collar depending from the first edge surface of the outer plate which supports the hinge pin, and a second pin collar depending from the first edge surface of the inner plate which rotates about the hinge pin.

13. The improved stilt device of claim 1, wherein the support pole comprises an outer sleeve which telescopically extends from an inner sleeve to facilitate selective adjustment of the distance between the clam-shell assembly and the shoe plate.

14. The improved stilt device of claim 1, wherein the leg attachment assembly further comprises a support attachment assembly configured to adjustably connect the medial portion of the support pole to the shoe plate, the support attachment assembly comprising:

a substantially u-shaped bracket having a medial portion between a pair of opposing support arms, the medial portion connected to the shoe plate;

a substantially h-shaped clamp nested within the u-shaped bracket and having a central web which supports a pair of opposing clamping arms, the pair of opposing clamping arms each comprising an inner arcuate clamping surface configured to abut the support pole;

a first fastener which extends through the respective support arms and through the central web of the h-shaped clamp to establish a desired angular extent of the support pole with respect to the shoe plate, the first fastener on a first side of the support pole; and a second fastener which extends through the pair of opposing clamping arms on a second side of the support pole opposite the first side to cause the respective clamping surfaces to pressingly engage the support pole.

15. In a stilt device for supporting a user above a base support surface of the type comprising a laterally extending shoe plate adapted to abuttingly support a foot of the user, a laterally extending base member adapted for abutting contact with the base support surface, and at least one support strut extending between the shoe plate and the base member which establishes a relative elevational spacing therebetween, the improvement comprising:

a leg attachment assembly configured to support the leg of the user, comprising:

an elongated support pole having a proximal end, a distal end and a medial portion, the proximal end affixed to the at least one support strut, the medial portion extending adjacent the shoe plate and the distal end configured to extend adjacent the leg of the user; and a support attachment assembly which adjustably connects the support pole to the shoe plate, comprising:

a substantially u-shaped bracket having a medial portion between a pair of opposing support arms, the medial portion connected to the shoe plate;

a substantially h-shaped clamp nested within the u-shaped bracket and having a central web which supports a pair of opposing clamping arms, the pair of opposing clamping arms each comprising an inner arcuate clamping surface configured to abut the support pole;

a first fastener which extends through the respective support arms and through the central web of the h-shaped clamp to establish a desired angular extent of the support pole with respect to the shoe plate, the first fastener on a first side of the support pole; and a second fastener which extends through the pair of opposing clamping arms on a second side of the support pole opposite the first side to cause the respective clamping surfaces to exert a clamping force upon the support pole.

16. The improved stilt device of claim 15, wherein the support pole comprises an outer sleeve which telescopically extends from an inner sleeve to facilitate selective adjustment of the distance between a clam-shell assembly and the shoe plate, and wherein the clamping force exerted by the clamping arms maintains the outer sleeve in a fixed relation to the inner sleeve.

17. The improved stilt device of claim 15, wherein the support arms of the u-shaped bracket comprise elongated slots to accommodate the first fastener and allow the relative position of the h-shaped clamp to be advanced and retracted to change the angular extent of the support pole.

18. The improved stilt device of claim 15, wherein the clamping arms each comprise a fastener tab with a central aperture to accommodate the second fastener.

19. The improved stilt device of claim 15, wherein the first fastener is aligned along a first axis substantially normal to the axial extent of the support pole.

20. The improved stilt device of claim 15, wherein the second fastener is aligned along a second axis substantially normal to the axial extent of the support pole, and wherein the first axis is substantially parallel to the second axis.

21. The improved stilt device of claim 15, wherein the leg attachment assembly further comprises a clam-shell assembly supported by the distal end of the support pole configured to support a leg of the user, comprising:

a curved outer plate having a convex outer surface, a concave inner surface, and opposing first and second edge surfaces;

a curved inner plate in facing relation to the outer plate and having a convex outer surface, a concave inner surface and first and second edge surfaces; and a hinge assembly connected between the respective first ends of the inner and outer plates facilitating rotation of the inner plate with respect to the outer plate between an open position and a closed position, the open position accommodating insertion of the leg of the user, the closed position aligning the respective second edge surfaces of the inner and outer plates.

22. The improved stilt device of claim 21, further comprising a third fastener which connects the medial portion of the u-shaped bracket to the shoe plate.

23. The improved stilt device of claim 22, wherein the shoe plate comprises opposing top and bottom surfaces with the top surface configured to abuttingly support the foot of the user, wherein the shoe plate further comprises opposing brackets which project from the bottom surface, each said bracket having an aperture to receive and support the third fastener a first selected distance from the bottom surface, and wherein the shoe plate further comprises at least one strengthening rib between and contactingly abutting the opposing brackets which extends from the bottom surface a second selected distance greater than the first selected distance.

24. The improved stilt device of claim 22, wherein the shoe plate comprises a medial portion support rib which contactingly supports the medial portion of the u-shaped bracket a selected distance from the third fastener to prevent rotation of the u-shaped bracket with respect to the shoe plate.

25. In a stilt device for supporting a user above a base support surface of the type comprising a laterally extending shoe plate adapted to abuttingly support a foot of the user, a laterally extending base member adapted for abutting contact with the base support surface, and at least one support strut extending between the shoe plate and the base member which establishes a relative elevational spacing therebetween, the improvement comprising:

a leg attachment assembly configured to support the leg of the user, comprising:

an elongated support pole having a proximal end, a distal end and a medial portion, the proximal end affixed to the at least one support strut and the medial portion extending adjacent the shoe plate;

a clam-shell assembly supported by the distal end of the support pole configured to support a leg of the user, comprising:

a curved outer plate having a convex outer surface, a concave inner surface, and opposing first and second edge surfaces;

a curved inner plate in facing relation to the outer plate and having a convex outer surface, a concave inner surface and first and second edge surfaces; and a hinge assembly connected between the respective first ends of the inner and outer plates facilitating rotation of the inner plate with respect to the outer plate between an open position and a closed position, the open position accommodating insertion of the leg of the user, the closed position aligning the respective second edge surfaces of the inner and outer plates; and a support attachment assembly which adjustably connects the support pole to the shoe plate, comprising:

a substantially u-shaped bracket having a medial portion between a pair of opposing support arms, the medial portion connected to the shoe plate;

a substantially h-shaped clamp nested within the u-shaped bracket and having a central web which supports a pair of opposing clamping arms, the pair of opposing clamping arms each comprising an inner arcuate clamping surface configured to abut the support pole;

a first fastener which extends through the respective support arms and through the central web of the h-shaped clamp to establish a desired angular extent of the support pole with respect to the shoe plate, the first fastener on a first side of the support pole; and a second fastener which extends through the pair of opposing clamping arms on a second side of the support pole opposite the first side to cause the respective clamping surfaces to exert a clamping force upon the support pole.

26. A shoe plate for use in a stilt device to support a user above a base support surface to extend the user's effective leg length, comprising:

opposing upper and lower surfaces, the upper surface configured to support a foot of the user;

a pair of opposing brackets which extend downwardly from the lower surface, each bracket having an aperture a first selected distance from the bottom surface accommodating a fastener affixing the shoe plate to a support strut extending between the shoe plate and a base member; of the stilt device and at least one strengthening rib between the pair of opposing brackets which extends downwardly from the lower surface and contactingly abuts each of said brackets, the strengthening rib having a length that extends from a first one of said brackets to a second one of said brackets and a thickness that extends in a direction normal to the length with the thickness being less than the length, the strengthening rib further extending adjacent to and in non-contacting relationship with the fastener and having a distal edge which extends from the bottom surface a second distance greater than the first distance and configured to resist compression of the pair of opposing brackets when the fastener is installed.

27. The shoe plate of claim 26, wherein the at least one strengthening rib is characterized as a first rib, and wherein the shoe plate further comprises a second strengthening rib disposed between the pair of opposing brackets and which extends downwardly from the lower surface to contactingly abut each of said brackets, wherein the first and second brackets further extend adjacent opposing sides of the fastener when the fastener is installed.

28. The shoe plate of claim 26, wherein the pair of opposing brackets each have a distal end that extends a third distance from the bottom surface of the shoe plate, and wherein the at least one strengthening rib extends substantially to the distal ends of said pair of opposing brackets.

29. The shoe plate of claim 26, wherein the stilt device comprises an elongated support pole having a proximal end, a distal end and a medial portion, the proximal end affixed to the at least one support strut, the medial portion attached to the shoe plate via a support pole bracket assembly and the distal end supporting a leg of the user, wherein the fastener further operates to attach the support pole to the shoe plate.

30. The shoe plate of claim 29, wherein the support pole bracket assembly comprises:

a substantially u-shaped bracket having a medial portion between a pair of opposing support arms, the medial portion connected to the opposing pair of brackets of the shoe plate via the fastener; and a substantially h-shaped clamp nested within the u-shaped bracket and having a central web which supports a pair of opposing clamping arms, the pair of opposing clamping arms each comprising an inner arcuate clamping surface configured to abut the support pole.

31. The shoe plate of claim 26, wherein each of the brackets extends from the shoe plate at a substantially 90 degree angle.

32. The shoe plate of claim 26, wherein the strengthening rib extends substantially parallel to the fastener so that a substantially uniform gap is provided between the rib and the fastener along the length of the rib, said gap being greater than the thickness of the rib.

* * * * *